United States Patent [19]

Roberts et al.

[11] 4,279,115

[45] Jul. 21, 1981

[54] HIGH SPEED STRAIGHT LINE CONTAINER SEALING MACHINE

[75] Inventors: Cecil P. Roberts, Carroll; Charles S. Ochs, Lancaster, both of Ohio

[73] Assignee: Anchor Hocking Corporation, Lancaster, Ohio

[21] Appl. No.: 20,011

[22] Filed: Mar. 12, 1979

[51] Int. Cl.[3] ..... B65B 7/28; B67B 3/20

[52] U.S. Cl. ..... 53/314; 53/315; 53/317; 198/531

[58] Field of Search ..... 53/313, 314, 315, 316, 53/317, 306, 88; 198/531

[56] References Cited

U.S. PATENT DOCUMENTS

| | | | |
|---|---|---|---|
| 2,658,654 | 11/1953 | Schweizer | 53/314 X |
| 2,750,722 | 6/1956 | Ferguson et al. | 53/315 X |
| 2,835,963 | 5/1968 | Drennan et al. | 53/314 X |
| 3,179,237 | 4/1965 | Ninneman | 53/367 X |
| 3,274,748 | 9/1966 | Roberts et al. | 53/88 X |
| 3,438,174 | 4/1969 | Foss et al. | 53/314 X |

*Primary Examiner*—Horace M. Culver

*Attorney, Agent, or Firm*—Holland, Armstrong, Wilkie & Previto

[57] ABSTRACT

A sealing machine is disclosed of the type which applies closure caps to containers at extremely high speeds by moving filled containers successively through a cap feeding station, a cap applying station, and a cap sealing station. The machine is characterized by improvements in its several sections which permit it to operate effectively at increased speeds, and at the same time provide for an improved adjustability for differing package sizes. The adjustability provides for independently operable adjustments for the sealing chamber height and for the width and height of the side belts which move the containers through the sealing chamber. Additionally, an improved cap feed is described with a cap feeding star wheel and improved container guiding side belts are also disclosed.

8 Claims, 23 Drawing Figures

Fig. 12.
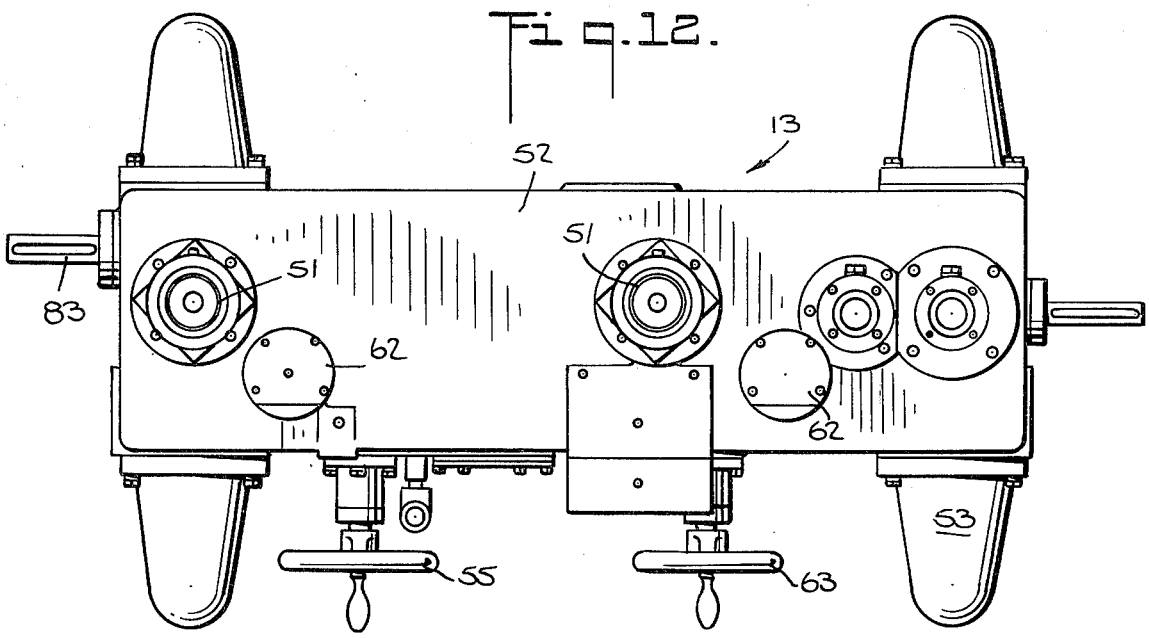
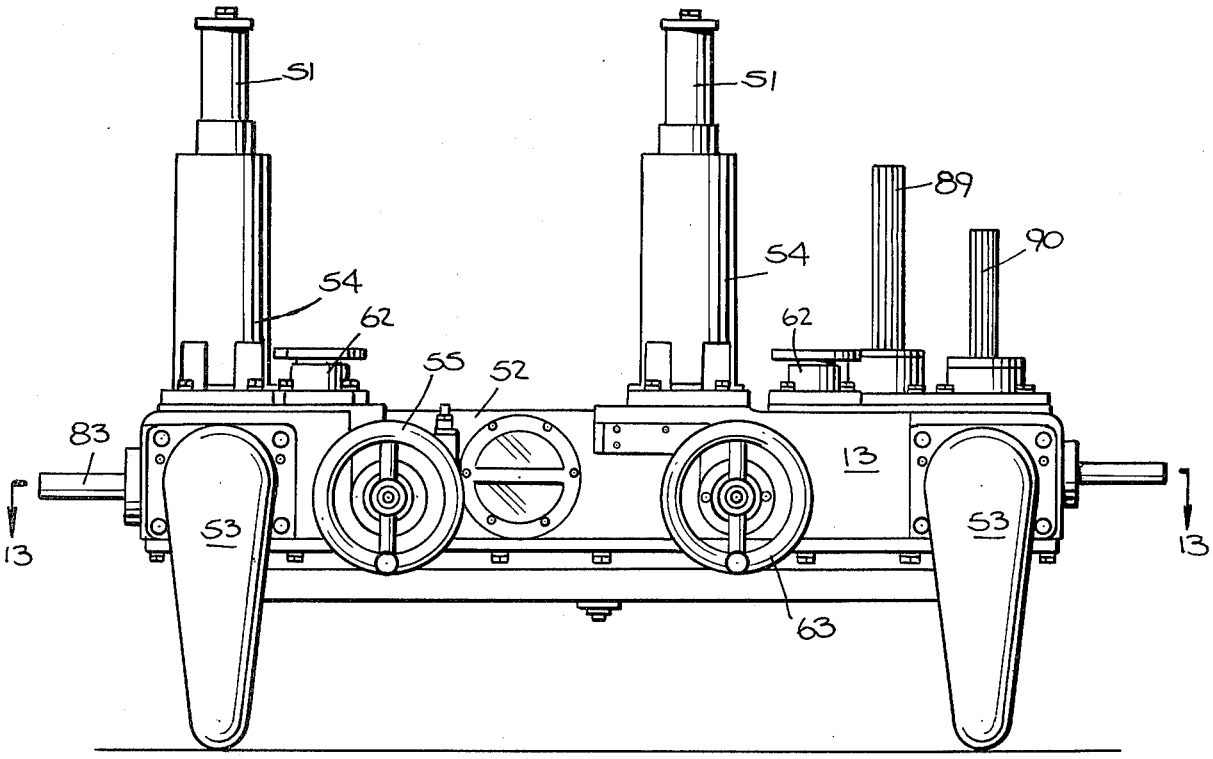
Fig. 11.

1
9
6
7
40
39
45
81
46
2
46
81
81
69
69
54
13
52
53

1
9
6
33
81
2
79
81
78
69
74
75
76
80
72
90
84
53

1
6
9
33
12
7
2
3
33
103
104
90
52
13
53
84

Fig.22.
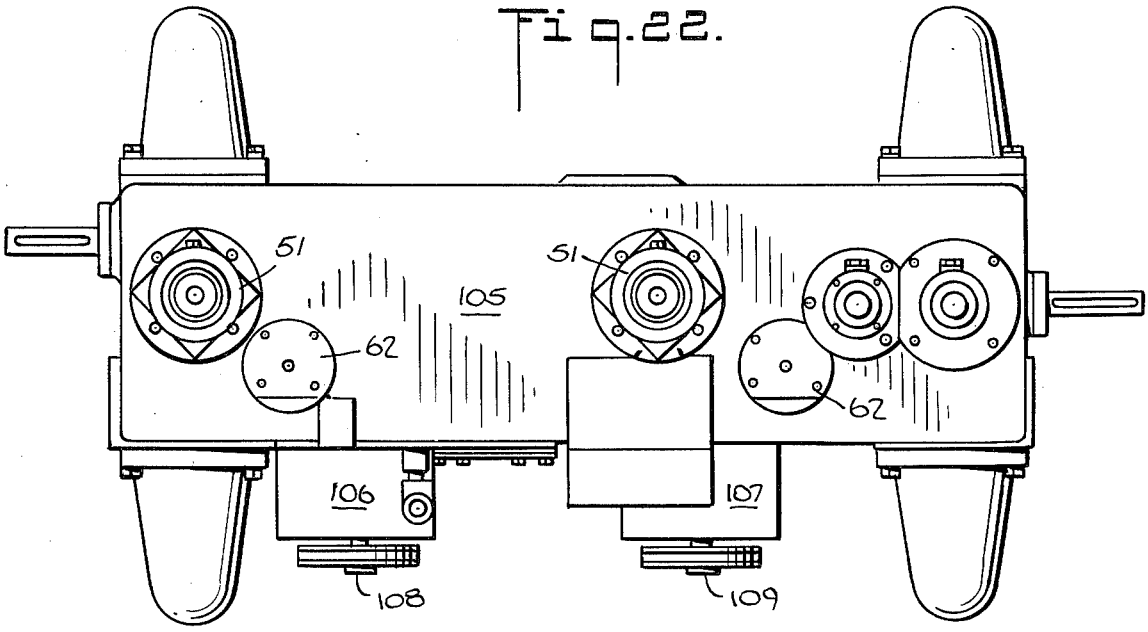
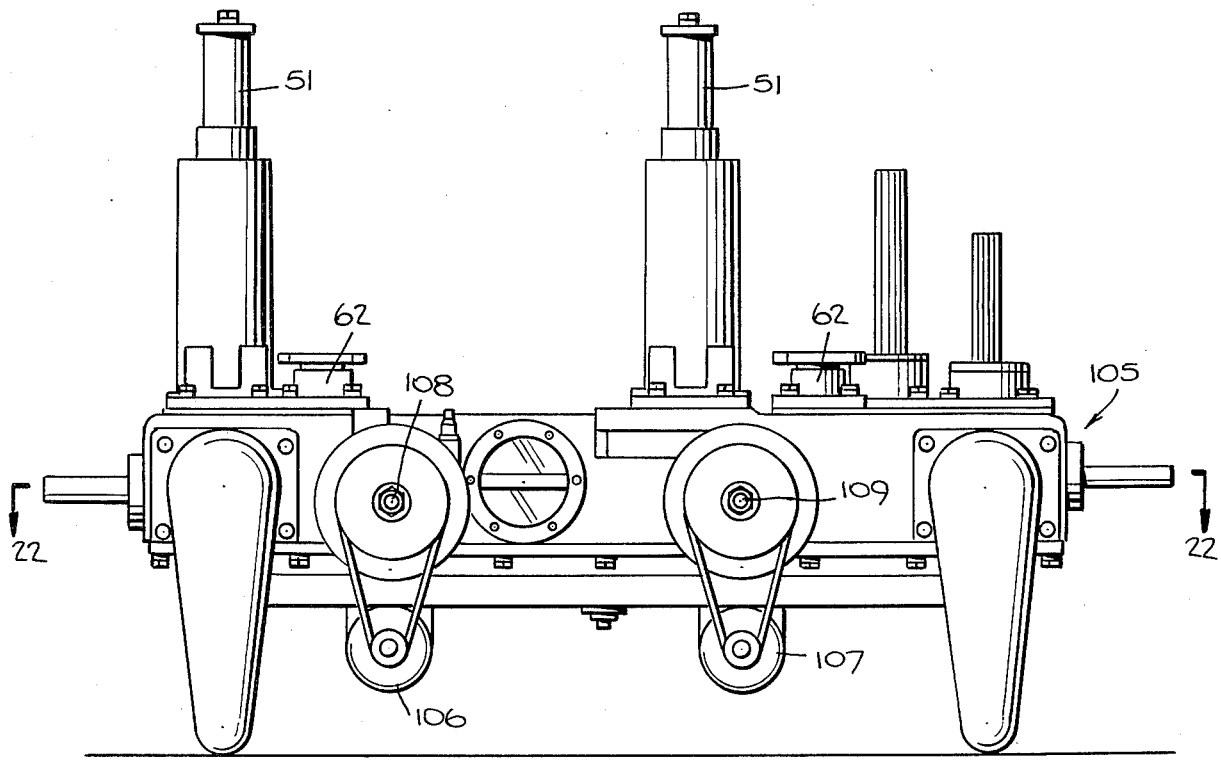
Fig.23.

HIGH SPEED STRAIGHT LINE CONTAINER SEALING MACHINE

BACKGROUND OF THE INVENTION

The present invention relates to the container sealing art and more particularly to an improved high speed and easily adjustable straight line container sealing machine.

Straight line sealing machines for sealing containers have been in use for many years. These machines are generally characterized by having a horizontal moving conveyor which carries filled and unsealed containers successively through a cap feeding device, a cap applicator device, and a cap sealing means which may or may not include vacuum sealing means. Although the known machines have proven capable of providing satisfactory sealing operations, these prior machines have had limited speed capabilities and an inability for being readily and simply adjusted for handling differing container and closure cap sizes and shapes. For example, where changes are made in the products being sealed and where these changes require differing closure cap and container sizes and shapes it has required considerable time and usually expert operators to reset the various portions of the sealing machines for the necessary changes. Attempts to run these prior sealing machines at ever increasing speeds have also resulted in tie-ups and breakage resulting from an inability of the machines to adequately control the container and cap feeds and the sealing operations at these higher speeds. The present sealing machine is an improvement, for example, upon earlier sealing machines of the types shown in U.S. Pat. Nos. 3,274,748 and 3,438,174 dated Sept. 27, 1966 and Apr. 15, 1969 respectively and owned by the assignee of the present invention.

In particular, the new machine of this invention has an improved base which provides independently adjustable supports for the vacuum chamber height as well as the heights and spacing of the container controlling side belts. The power feeds for the sealing heads and side belts and other moving parts are also at least partially contained in the machine base and permit all adjustments without affecting the drive synchronization.

The cap feed is improved for higher speed and is characterized by the use of a driven cap feed wheel and the side belts are adapted for improved container gripping and locating.

Accordingly, an object of the present invention is to provide an improved straight line sealing machine.

Another object of the present invention is to provide a straight line sealing machine for use at significantly increased container sealing speeds.

Another object of the present invention is to provide a straight line sealing machine which is easily adjusted by inexperienced personnel for closure cap and container size changes.

Another object of the present invention is to provide an improved high speed cap feed system for a straight line sealing machine.

Another object of the present invention is to provide an improved side belt container control system for a straight line sealing machine.

Another object of the present invention is to provide an improved sealing chamber and related cap feed chute end for a high speed straight line sealing machine.

Another object of the present invention is to provide a sealing machine structure adapted for adjustment using electric or hydraulic powered adjusting drives.

Another object of the present invention is to provide an easily adjustable side belt system for a straight line container sealing machine.

Other and further objects of the present invention will be apparent upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

FIG. 3 is an end elevational view of the sealing machine of FIG. 1.

FIG. 12 is a top plan view of the machine base of FIG. 11.

FIG. 13 is a horizontal sectional view of the machine base taken along line 13—13 on FIG. 11.

FIG. 22 is a front elevational view of another embodiment of the sealing machine base with powered adjusting means.

FIG. 23 is a top plan view of the machine base of FIG. 22.

DESCRIPTION OF THE PREFERRED EMBODIMENT

Figure 1:
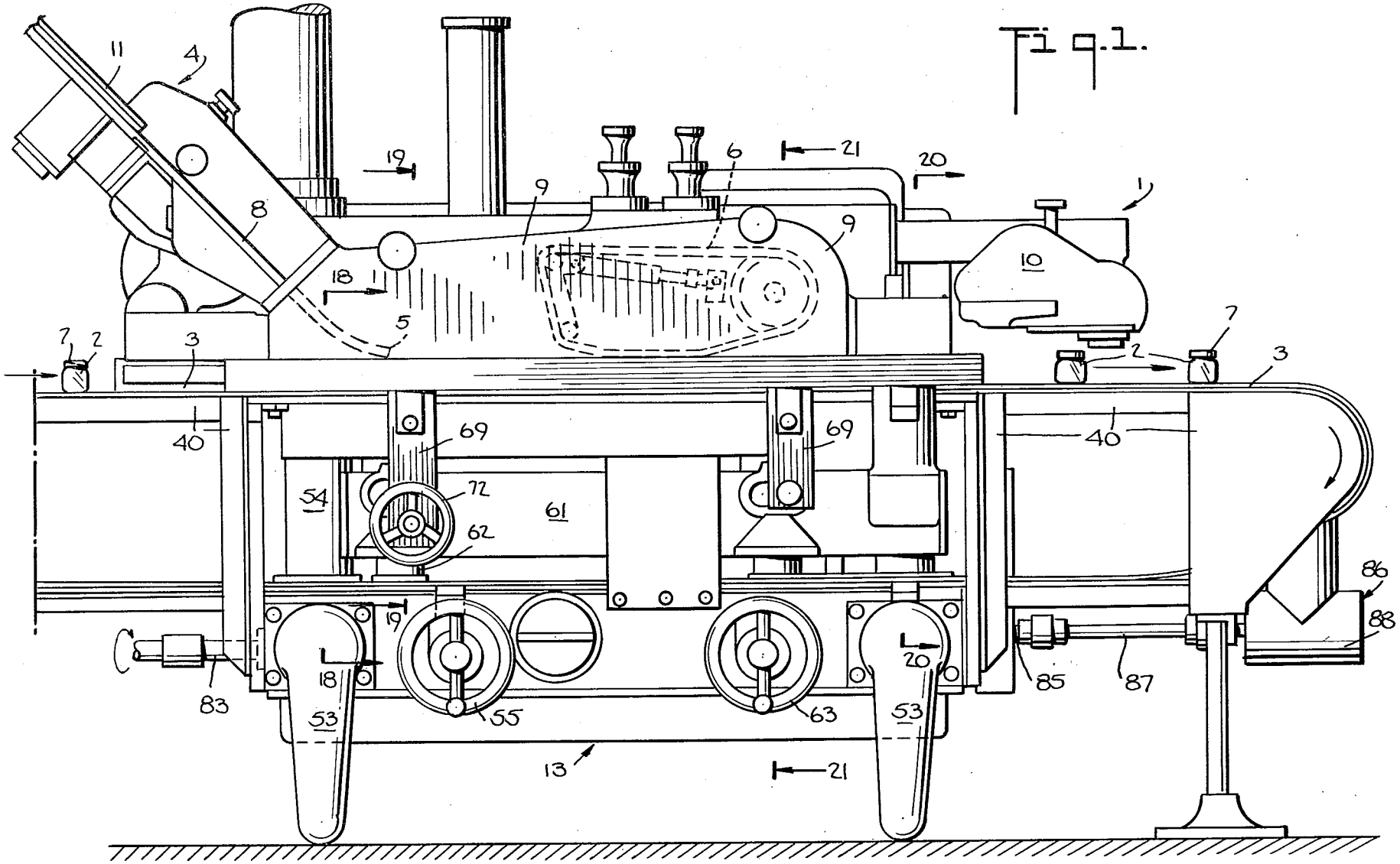
FIG. 1 is a front elevational view of the improved sealing machine in accordance with the invention.
Figure 2:
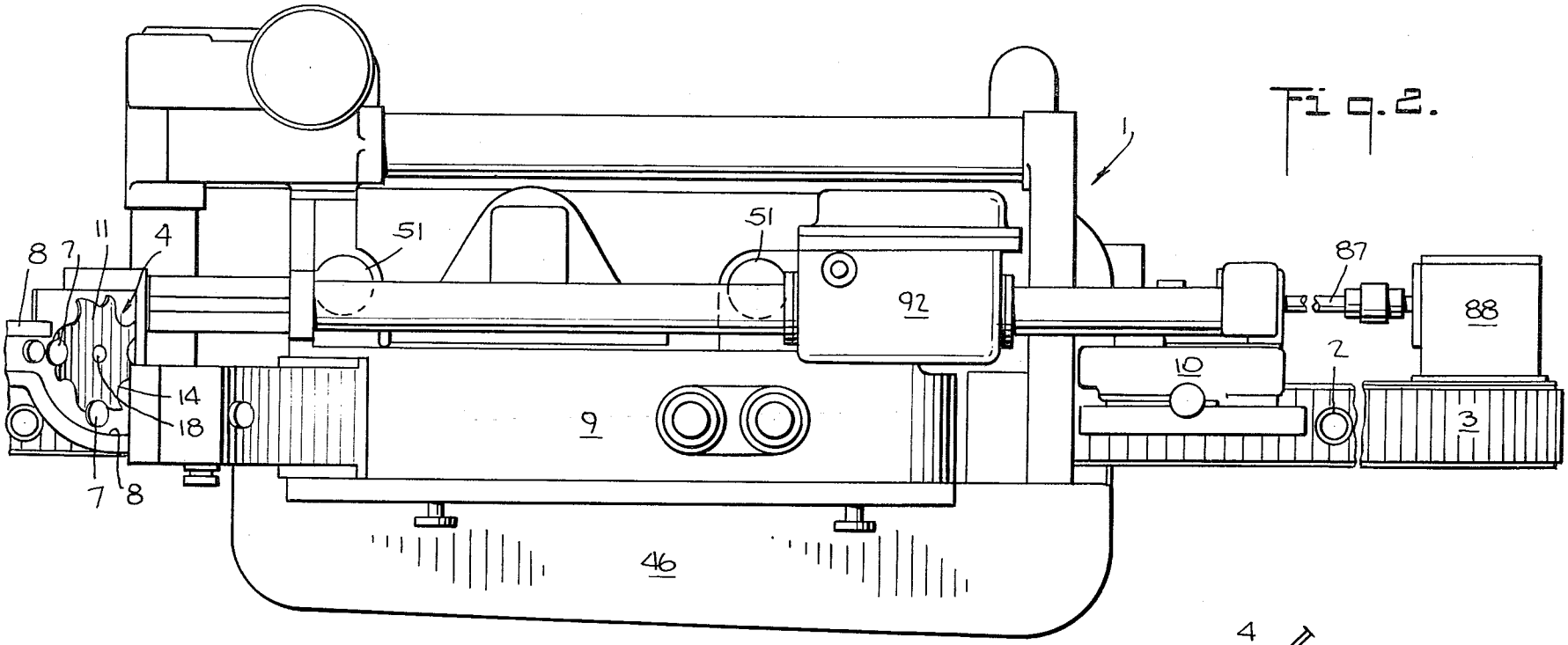
FIG. 2 is a top plan view of the sealing machine of FIG. 1.

The improved sealing machine will first be described generally with particular reference to FIGS. 1, 2 and 3. The sealing machine 1 carries the filled containers 2 on an endless conveyor 3, successively beneath a cap feeder 4, a cap applicator 5 and a cap sealing head 6. At the cap feeder 4, each moving container 2 draws a closure cap 7 from the lower end of a cap chute 8. The moving container 2 then carries the loosely telescoped cap through the cap applicator 5 which lightly coaxes or turns the cap 7 onto the container 2 in the case of a twist cap or levels the closure cap 7 in the case of a press-on type of closure cap. Thereafter the continuously moving container 2 carries the cap 7 further through a sealing chamber 9 where the sealing head 6 twists or presses the closure cap 7 tightly onto the container 2.

For vacuum sealing, a steam atmosphere is maintained at the lower end of the cap chute 8 and within the sealing chamber 9 in such a manner as to direct steam within the headspace of each container 2 before it is sealed resulting in the formation of a vacuum as the container cools after the sealing operation. An encoding device 10 properly synchronized with the sealed and moving containers 2 encodes or labels the closure of the sealed container. As will be more fully described below, with particular reference to FIGS. 5 and 6, the flow of the caps 7 downwardly through the cap feeding chute 8 is controlled by a rotating star wheel 11 which simultaneously controls feed pressure within the chute 8 and synchronizes the cap movements with container movements to the point of cap pickup just in advance of the cap applicator 5.

Moving side belts 12 engage and grip each of the containers 2 as they pass beneath the sealing chamber 9 to properly space and support the moving containers. The side belt 12 height and width adjustments, as will also be more fully described below, are provided in the base 13 which adjusts these belt positions, independently of the sealing chamber height. The height of the chamber 9 is also independently adjustable by means of a separate height adjustment which will be described below.

THE CAP FEED

The sealing machine 1 of the present invention operates at relatively high sealing speeds so that a means is required for feeding the closure caps 7 at a high and controlled feeding rate to the moving containers 2. The closure caps 7 are bed from a cap feeding hopper (not shown) which continuously feeds properly orientated caps into the top of the feed chute 8. The chute 8 confines and supports the caps as they are projected downwardly until they reach a pressure relieving and feed synchronizing cap feed wheel 11. The feed wheel 11 is driven in synchronism with other driven portions of the sealing machine including the container conveyor 3, the container gripping side belts 12, and the sealing head 6. Thus, each of the pockets 14 (FIGS. 5 and 6) in the rotating feed wheel 11 engage a closure cap 7 and carry it around to a release point 15 in the lower portion of the cap feed chute 8. A cap 7 released from the feed wheel 11 moves by gravity and by the momentum provided by the feed wheel 11 to a separately mounted feed shoe 16 (FIG. 7) at the lower end of the cap feeding chute 8 where the cap 7 is positioned to be engaged by and withdrawn from the feed shoe 16 by a container 2 being carried on the conveyor 3. Resilient detents or other release means 17 temporarily holds each cap within the shoe 16 until the cap 7 is engaged by the top of a moving container 2. A suitable feed shoe 16 and related cap applicator 5 are illustrated in copending U.S. application No. 940,554 filed Sept. 8, 1978 and owned by the assignee of the present invention.

Figure 4:
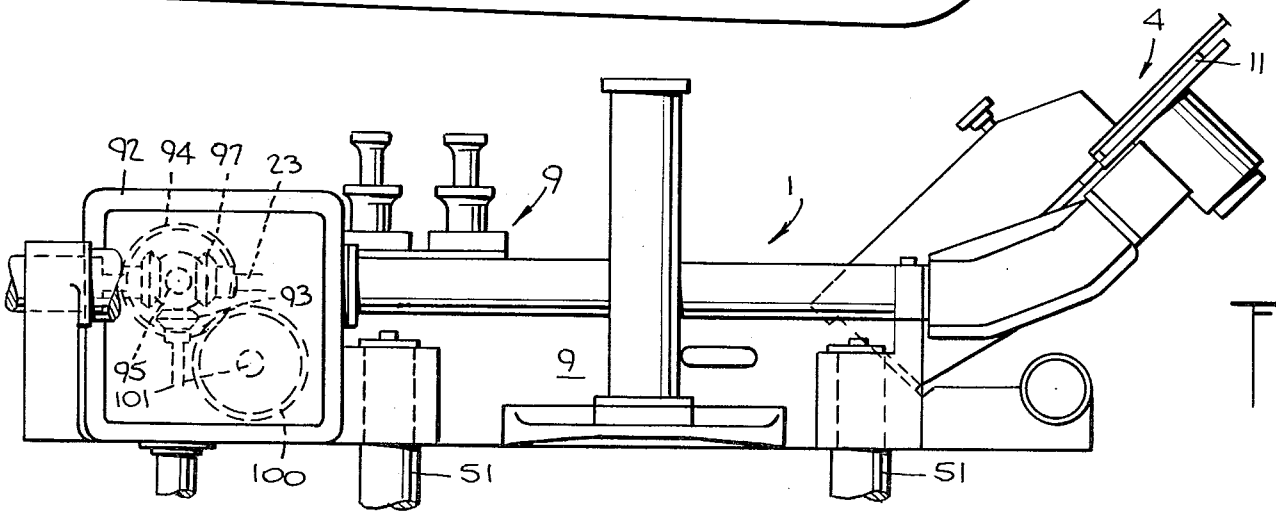
FIG. 4 is a detailed fragmentary rear elevational view of the sealing chamber and the cap chute end mounting.
Figure 6:
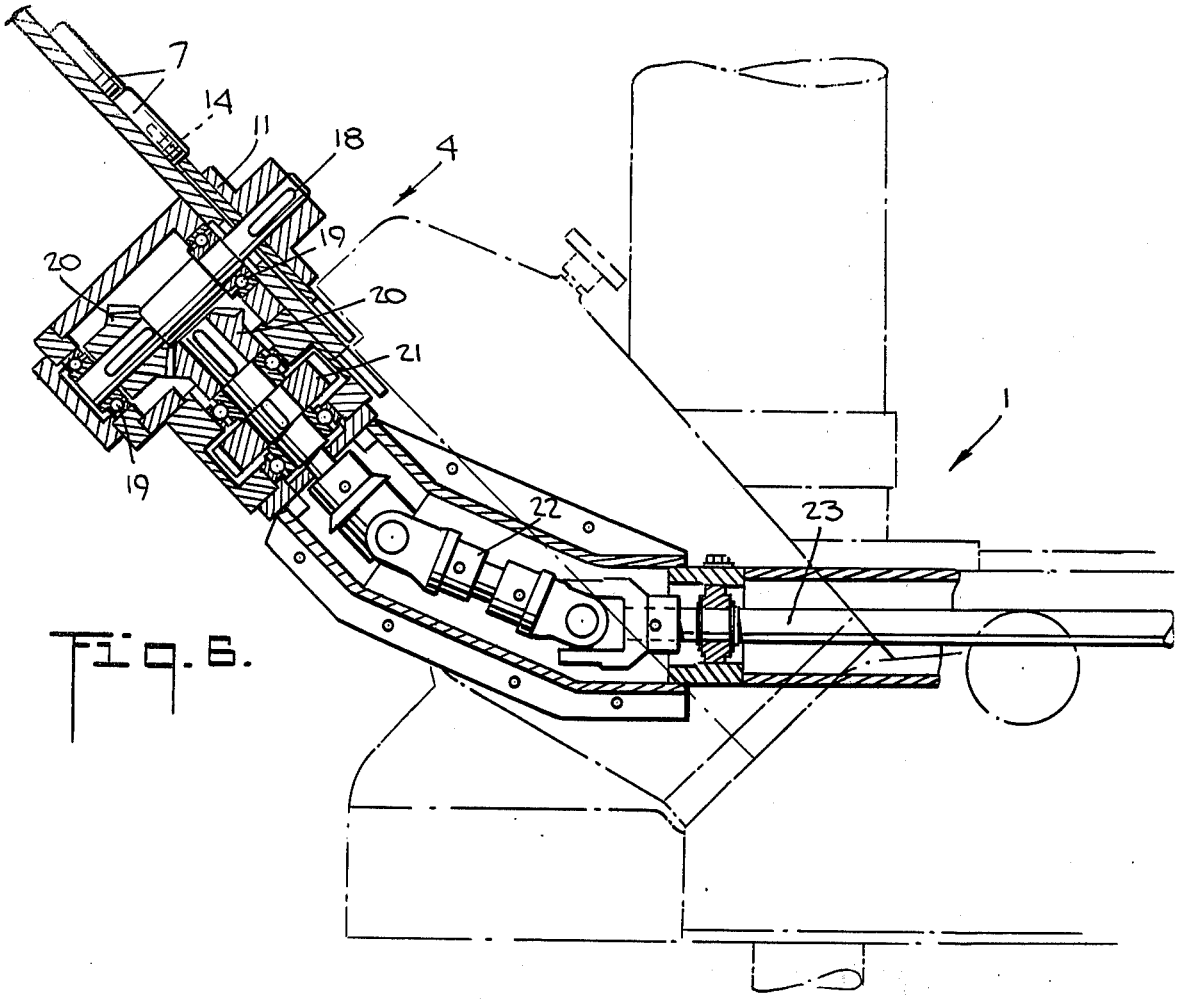
FIG. 6 is a vertical sectional view of the cap chute end and star wheel taken along line 6—6 on FIG. 5.
Figure 5:
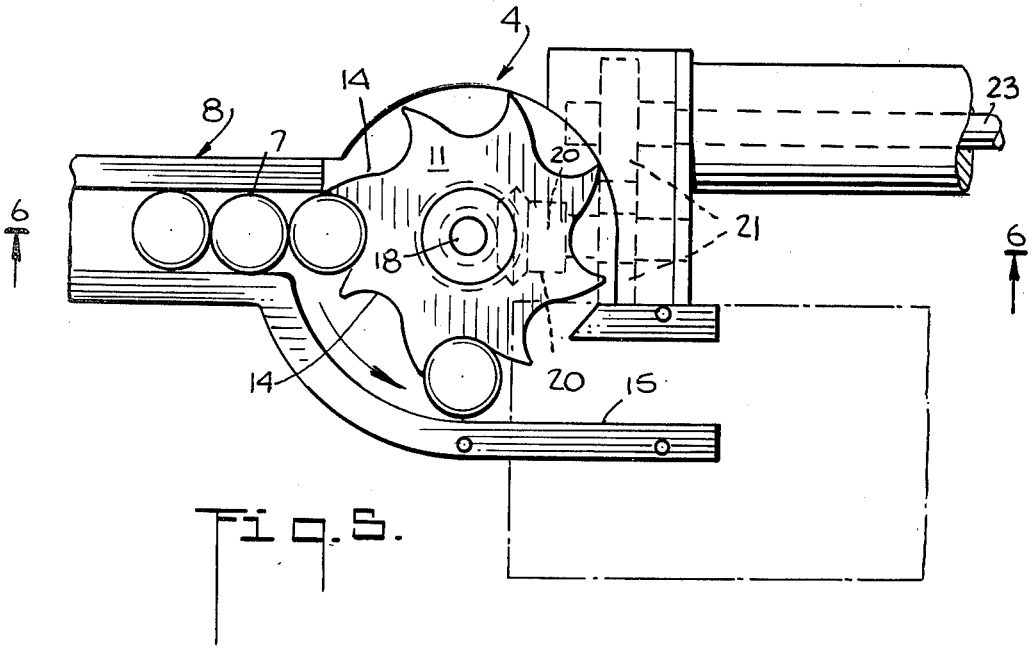
FIG. 5 is a detailed fragmentary top plan view illustrating the cap feeding end of the cap chute including the cap feeding star wheel.

A drive means for the rotating cap feed wheel 11 is illustrated in FIGS. 4, 5 and 6.

The feed wheel 11 is mounted on a suitable drive shaft 18 on bearings 19 which is driven through the intermediation of bevel gears 20, pinions 21, and a universal drive shaft 22 connected to a horizontal drive shaft 23 on the sealing chamber. The drive shaft 23 is coupled to the sealing machine drive system in the machine base 13 as will be described below.

The cap feeding wheel 11 provides important improved machine operating results where the caps 7 are being fed at a high feed rate and thus at a relatively high chute feeding pressure. As best illustrated in FIG. 5, the pockets 14 in the feed wheel 11 successively engage and support the endmost cap 7 in the line of caps being fed into the upper portion of the cap feed chute 8 at a relatively high rate and thus at a high feed pressure. The caps 7 are only released from the upper portion by the rotation of the feed wheel 11 which removes the endmost cap 7 from the line and from the chute feed pressure and then releases it for independent sliding movement down the chute 8 and to the cap release means 17 which releasably holds the caps in the feed shoe 16 until the cap 7 is pulled free by a moving container 2.

THE CLOSURE CAP APPLICATOR

Figure 7:
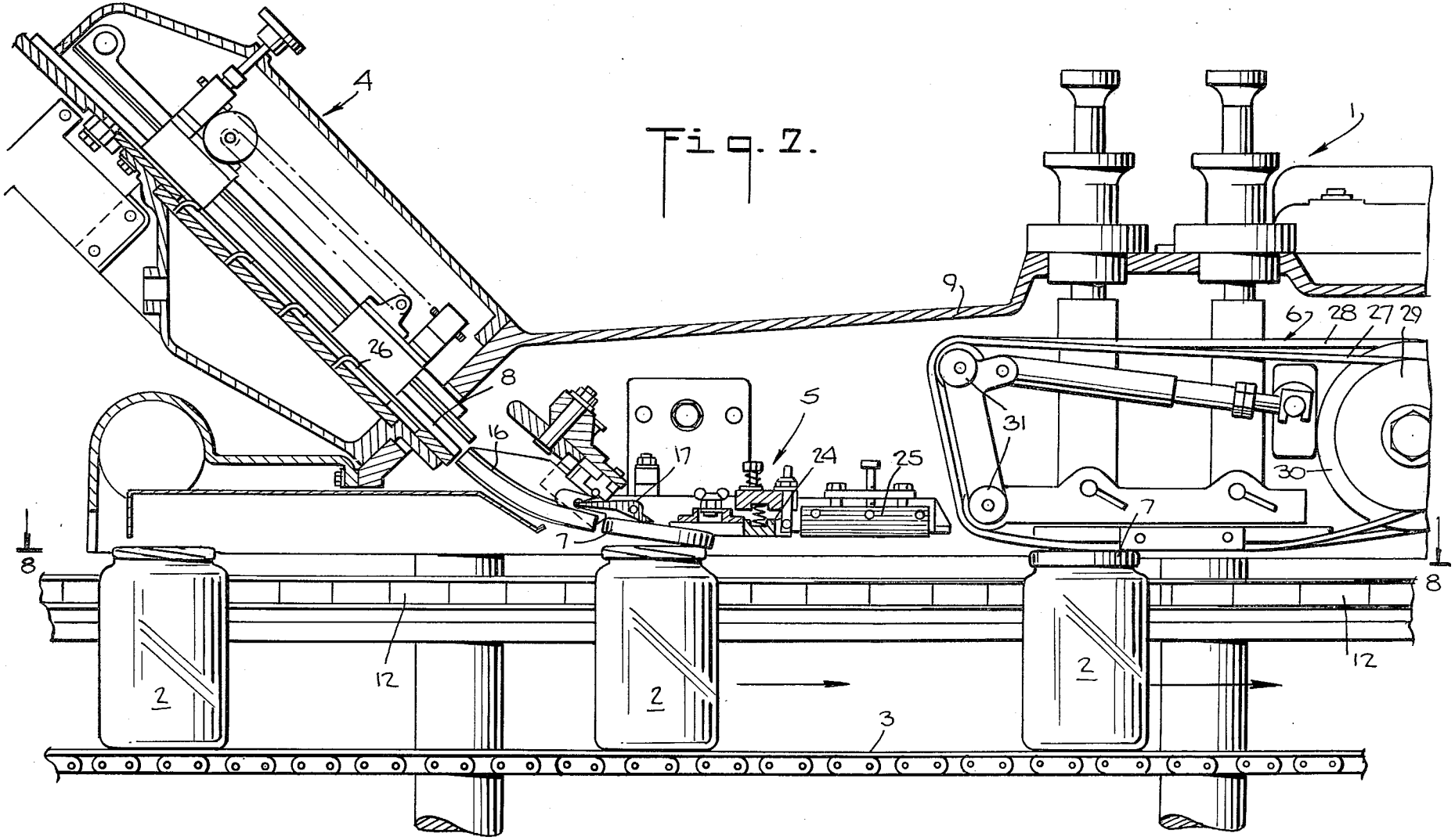
FIG. 7 is a detailed fragmentary vertical sectional view of the exit end of the cap feed chute and the adjacent vacuum chamber.
Figure 8:
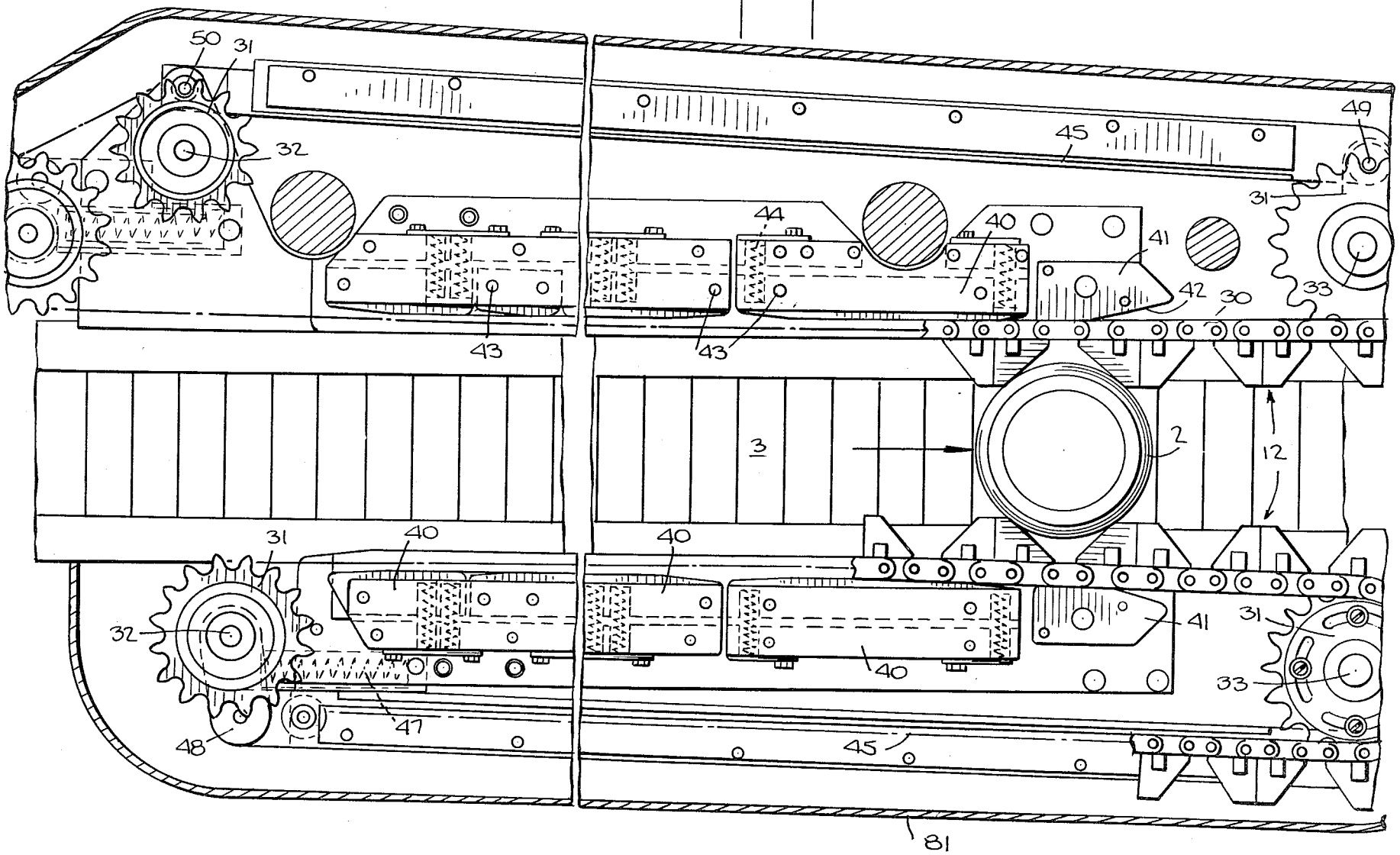

The function of the closure cap applicator 5, which is best illustrated in FIG. 7, is to control the release of each cap 7 from the chute 8 onto the top of a moving container 2 and to thereafter lightly coax or position the cap on the container finish preparatory to the final sealing action at the sealing head 6. A variety of applicators may be used with the sealing machine of this invention including those of the above referred to U.S. patents or a preferred form described and illustrated in the above referred to copending patent application.

Briefly, the cap applicator 5 has means for lightly pressing the closure caps 7 onto the finishes of the moving containers 2 and for leveling them and placing them in position for the final sealing action. In the case of press-on closures this means includes a pressure shoe which lightly presses and levels each cap into position on a moving container. For threaded or lugged caps the applicator 5 includes means for simultaneously leveling each closure cap 7 and for lightly twisting it onto cooperating container lugs or threads. The applicator illustrated in FIG. 7, for example, includes a spring mounted leveling plate 24 positioned in advance of an off-center cap drag shoe 25 which lightly turns each cap onto the threads of a moving container by retarding an off-center portion of the cap.

As each container 2 leaves the cap applicator 5 it has a closure cap lightly or initially positioned at its mouth for the final sealing operation for vacuum sealing. The container head space, which is the space between the product and the closure cap is filled with steam injected from the suitable nozzles 26 in the cap chute and the lower portion of the cap chute support as well as outlets (not shown) in the sealing chamber. A vacuum occurs in the sealed containers 2 when the steam condenses as it cools subsequent to the container sealing operation.

THE SEALING HEAD

After each container 2 is moved beyond the cap applicator 5, it next moves beneath the container sealing head 6 mounted on the sealing chamber 9. The function of the sealing head 6 is to either push press-on closures tightly onto the containers 2 or in the case of lugged or threaded closure caps, to twist them tightly onto the containers 2. A known type of sealing head is illustrated at 6 in FIGS. 1 and 7. This may be, for example, sealing heads of the type described in more detail in the above referred to U.S. patents. Briefly, where the sealing head 6 is employed for lugged or threaded caps, it engages them and twists them into sealing engagement with the containers. The rotating action is obtained by retarding an off-center portion of each cap 7 by a slower moving endless sealing belt 27 while turning an opposite off-center portion of each cap by means of a faster moving sealing belt 28. The sealing belts are mounted on a drive pulleys 29 and 30 and a number of idler pulleys 31. The slower moving sealing belt 27 may be replaced by a stationary drag shoe. The drive means for the drive pulleys is synchronized with the other moving portions of the machine by being coupled to the main drive in the machine base 13 as will be further described. Since the sealing head 6 is mounted on the sealing chamber 9, its height is adjusted as the chamber 9 is moved up and down with a corresponding height adjustment of the applicator 5 and cap chute 8 already described. The support which permits these adjustments without changing the synchronization of the driven portions of the sealing chamber is also an integral portion of the improved machine base 13 which will be described below in greater detail.

CONTAINER SIDE BELTS

Figure 9:
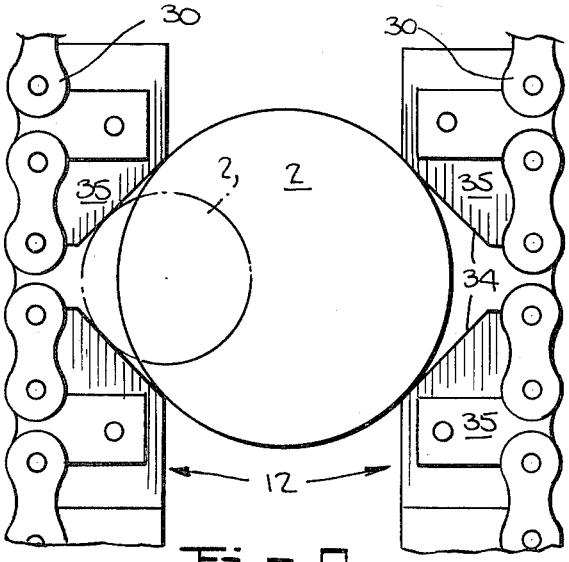
FIG. 9 is a fragmentary enlarged top plan view illustrating side chains having a pocket in engagement with a container.
Figure 10:
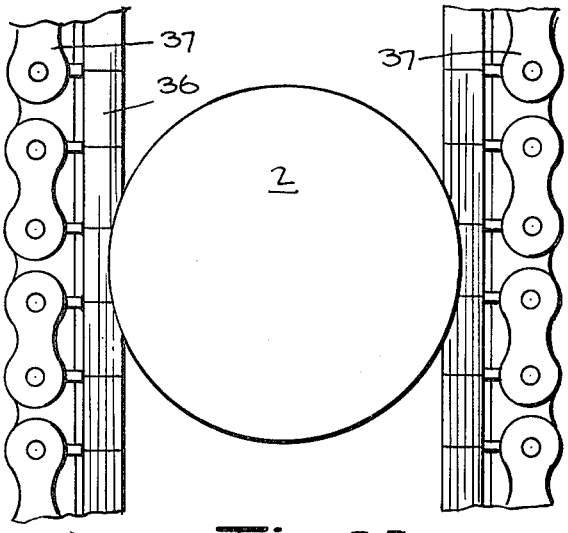
FIG. 10 is a fragmentary enlarged top plan view corresponding to FIG. 9 illustrating a differing embodiment of the side chains.

In order to provide for a higher speed sealing machine operation, the containers 2 are supported on the moving horizontal conveyor 3 and are held by the side belts 12 positioned above the conveyor 3. The container conveyor 3 comprises a conventional metal or plastic endless link conveyor belt driven by spaced and sprockets coupled to the machine drive and synchronized with the other driven portions of the machine. The side belts 12 each comprise an endless roller chain 30 mounted on sprockets 31 on spaced vertical end shafts 32 and 33. As illustrated in FIG. 9 the side belts 12 comprise the roller chains 30 having container spacing pockets 34 provided by plastic spacers 35 attached to the roller chains 30. The end shafts 32 and 33 are coupled to the main machine drive system by a means which permits adjustment of the side belt 12 heights without changing the side belt synchronization and independently of the height of the sealing chamber 9. The drive means for the side belts together with its synchronizing features will also be described below in the description of the improved machine base and drive means. FIG. 10 illustrates another embodiment of the side chains having smooth and resilient container gripping members 36 fastened to the roller chains 37 for feeding randomly spaced containers.

Figure 8:
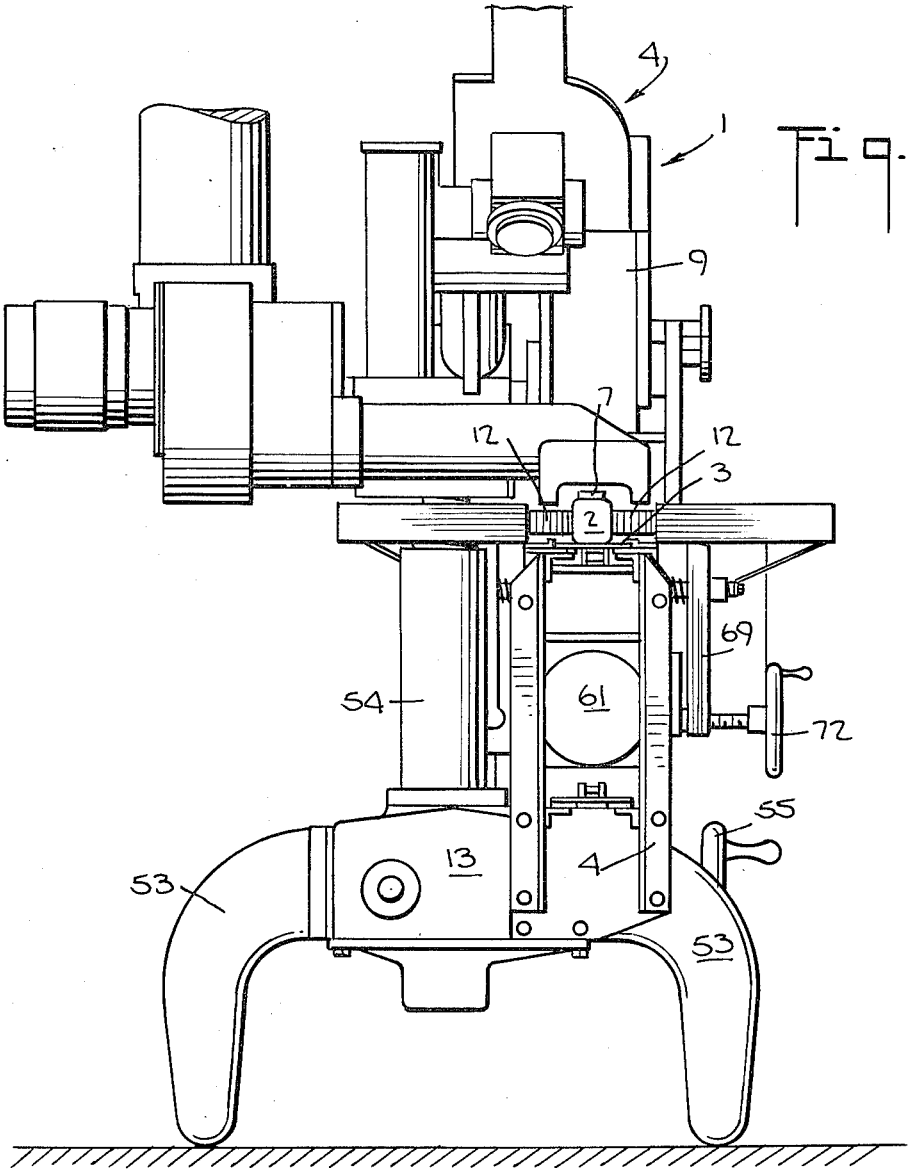
FIG. 8 is a horizontal sectional of the vacuum chamber taken along line 8—8 of FIG. 7.
Figure 18:
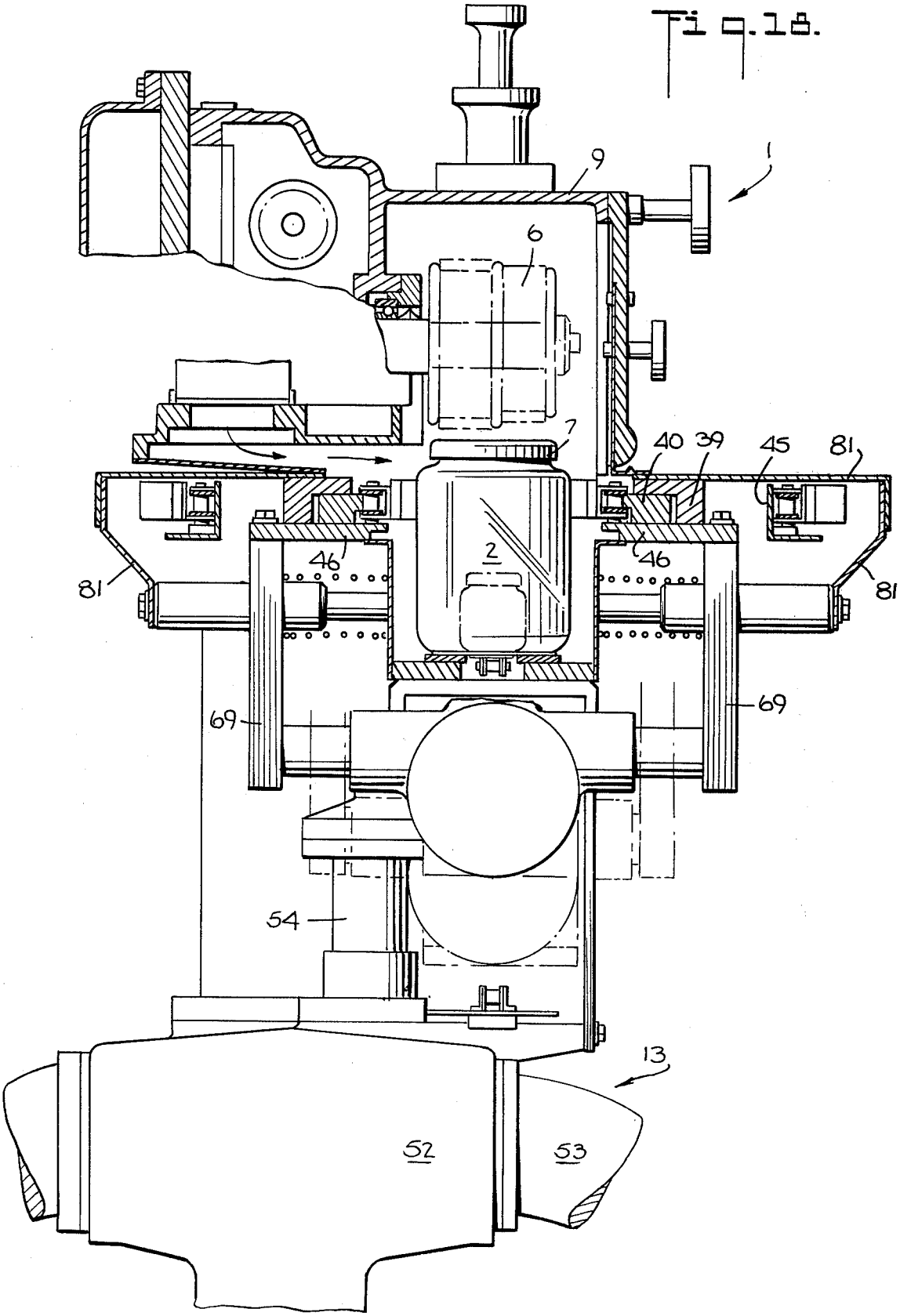
FIGS. 18 through 21 are vertical sectional views of the sealing machine taken along lines 18 through 21 respectively on FIG. 1.

Means is provided for guiding the roller chains 30 and 37 and for causing the moving side belts 12 to tightly grip the containers 2 particularly as they are moved beneath the cap applicator 5 and the sealing head 6. A preferred embodiment of the side belt guide assembly 38 is illustrated in FIGS. 8 and 18. The inner run of each of the two side belts is positioned by elongated backup bars 39 which slidably mount a series of chain guide pads 40. The pads 40 are formed of long wearing, low friction materials such as fiber reinforced phenolic pads or other low friction plastic materials. The guide pads 41 at the exit ends of the side belts 12 comprise fixedly mounted pads with tapered chain guiding surfaces 42. The pads 40 are slidably mounted on guide pins 43 for movement towards each other and in a container gripping direction under the force of compressed coil springs 44 which urge the pads 40 and the belts 12 inwardly towards the moving containers 2. The outer runs of the side belts 12 are slidably supported on suitably shaped flange members 45.

The heights of the exit end drive sprockets 31 are adjustable, as described below, however, the vertical axes of the drive shafts 33 for the exit sprockets 31 are fixed. The remaining elements of the belt guide assembly 38 move laterally for the belt spacing adjustment on the mounting plates 46 (FIG. 18). The roller chains 30 and 37 are kept under the proper tension during the belt width adjustments by the spring 47 and the link pivot 48 mounting for the idler entrance end sprockets 31. The flange members 45 are mounted on a fixed pivot 49 adjacent the drive sprockets 31 at the exit end and on a pivot 50 at the entrance end which moves with the mounting plates 46.

THE IMPROVED MACHINE DRIVE AND SEALING CHAMBER AND SIDE BELT ADJUSTMENTS

Although it is particularly advantageous to use high capacity container sealing machines with simple adjusting means for changing the machine settings for differing cap and container sizes, prior machines have not had this capacity due to the supposed complexity of such a design. The present sealing machine, however, provides for both a high speed sealing capacity as well as for adjustments which must be made for the particular size of the caps and containers being sealed. The improved machine drive and adjusting means will now be described together with its cooperation with the various operating elements of the sealing machine already described.

The improvement will first be described generally, with particular reference to FIGS. 1, 11, 12 and 17.

As already described, the means for moving the containers through the sealing machine 1 includes a conveyor belt 3 mounted on suitable end sprockets at a fixed height on a support frame 40. The cap feeding and sealing elements including the cap chute 8, the cap pickup 5 and the sealing head 6 are mounted on or in fixed relation to the sealing chamber 9 positioned above the conveyor 3. It is desirable that chamber 9 positioned together with the elements mounted thereon be adjustable vertically permitting a rapid adjustment of the sealing machine for handling containers of differing heights. It is also desirable that this adjustment be made without changing the previously set up synchronization between the several elements such as the cap feeder 4, the sealing head 6, and the coder 10 mounted on the sealing chamber 9.

As will be described in greater detail below, the sealing chamber 9 height adjustment is provided by mounting it on a pair of longitudinally spaced support columns 51. The columns 51 are adjustably mounted on the machine base 13 which includes means for raising and lowering the columns 51 together with the sealing chamber 9 supported thereon.

Figure 11:
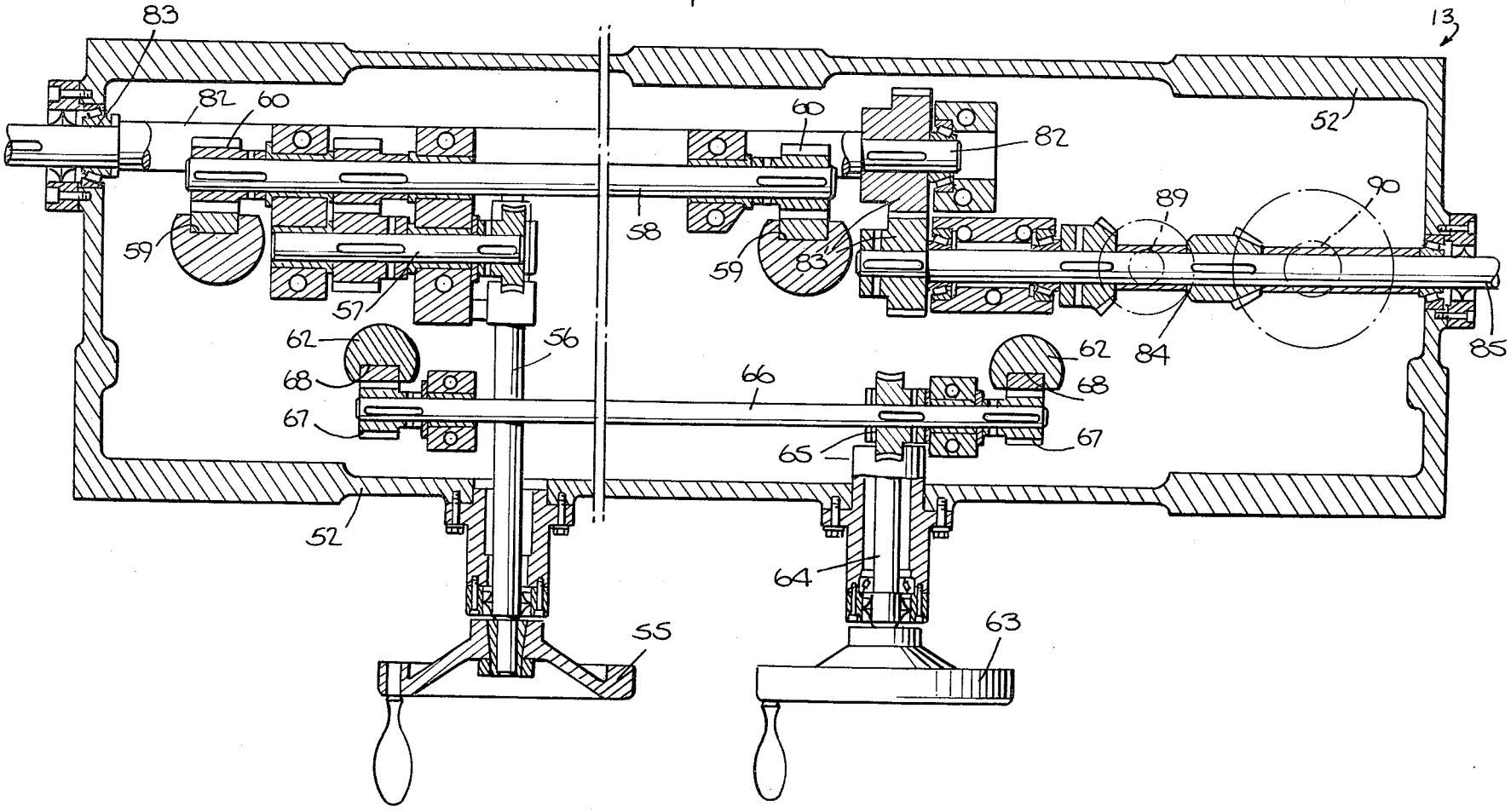
FIG. 11 is a front elevational view of the sealing machine base.
Figure 17:
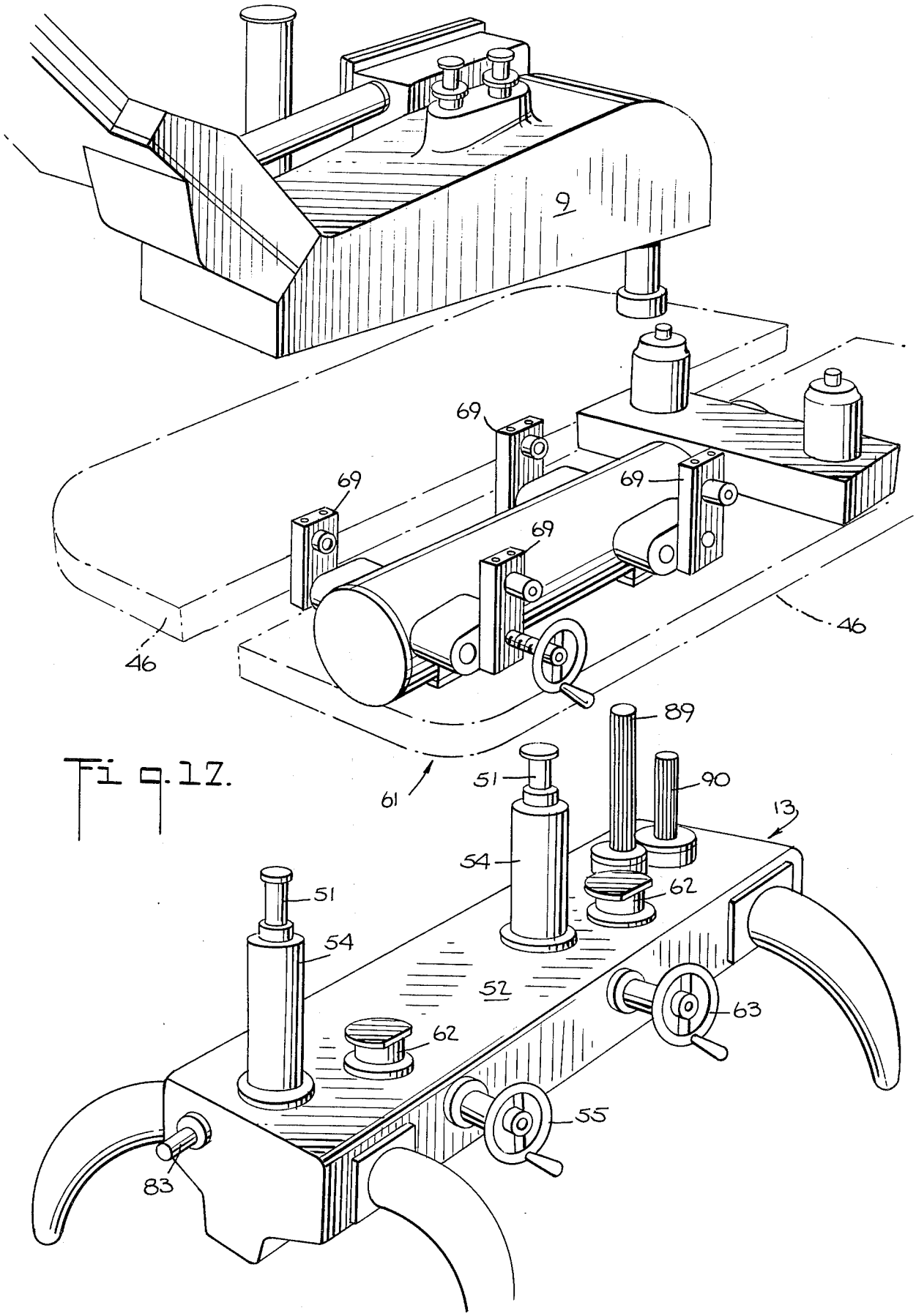
FIG. 17 is an exploded perspective view of the machine base, the side belt support assembly and the sealing chamber of the sealing machine of FIG. 1.

The machine base 13 also includes significant portions of the machine drive assembly as well as means for supporting and adjusting the spacing and height of the container supporting side belts 12. FIGS. 11, 12 and 17 illustrate the machine base 13 which includes a hollow sealed chamber 52 containing the various adjusting and driving elements and adapted for being filled with a lubricating oil for the protection of the adjusting and driving elements. The chamber 52 is supported on four legs 53 at a fixed height. The two sealing chamber support columns are slidably mounted on suitable elongated support bearings 54 with their upper ends being bolted or otherwise attached to the sealing chamber 9. The height of the two support columns 51 is simultaneously adjusted by means of the sealing chamber adjusting wheel 55 which is operatively coupled to the two columns 51 by means of the coupling system illustrated in FIG. 13. The adjusting wheel 55 is attached to a connecting shaft 56 which is in turn connected through an idler shaft 57 and suitable gearing to a column connecting shaft 58. Rotation of the adjusting wheel 55 rotates the connecting shaft 58 in one direction or the other to simultaneously raise or lower the sealing chamber support columns 51 through the intermediation of interconnected racks 59 on the columns 51 and pinions 60 on the connecting shaft 58.

As already indicated, adjusting means are also included in the machine base 13 for adjusting the container side belt 12 heights and spacing. The side belt adjusting means includes a side belt support assembly 61 illustrated in FIGS. 17 and 21. The support assembly 61 is mounted on a pair of assembly mounting columns 62 adjustably positioned on the machine base 13. A side belt height adjusting wheel 63 is coupled to the two columns 62 to raise and to lower the side belt support assembly 61 and to thus raise and lower the side belts 12 themselves. The adjusting wheel 63 is coupled to the two columns 62, as illustrated in FIG. 13, through the intermediation of a lateral connecting shaft 64 which is coupled by suitable gears 65 to a longitudinal coupling shaft 66 having pinions 67 on its opposite ends for engaging suitable racks 68 on the two columns 62. Rotation of the side belt height adjusting wheel 63 in one direction or the other raises or lowers the entire side belt support assembly 61 together with the side belts 12 which are attached thereto by means of the plates 46 and the support arms 69.

Figures 14, 15, 16:
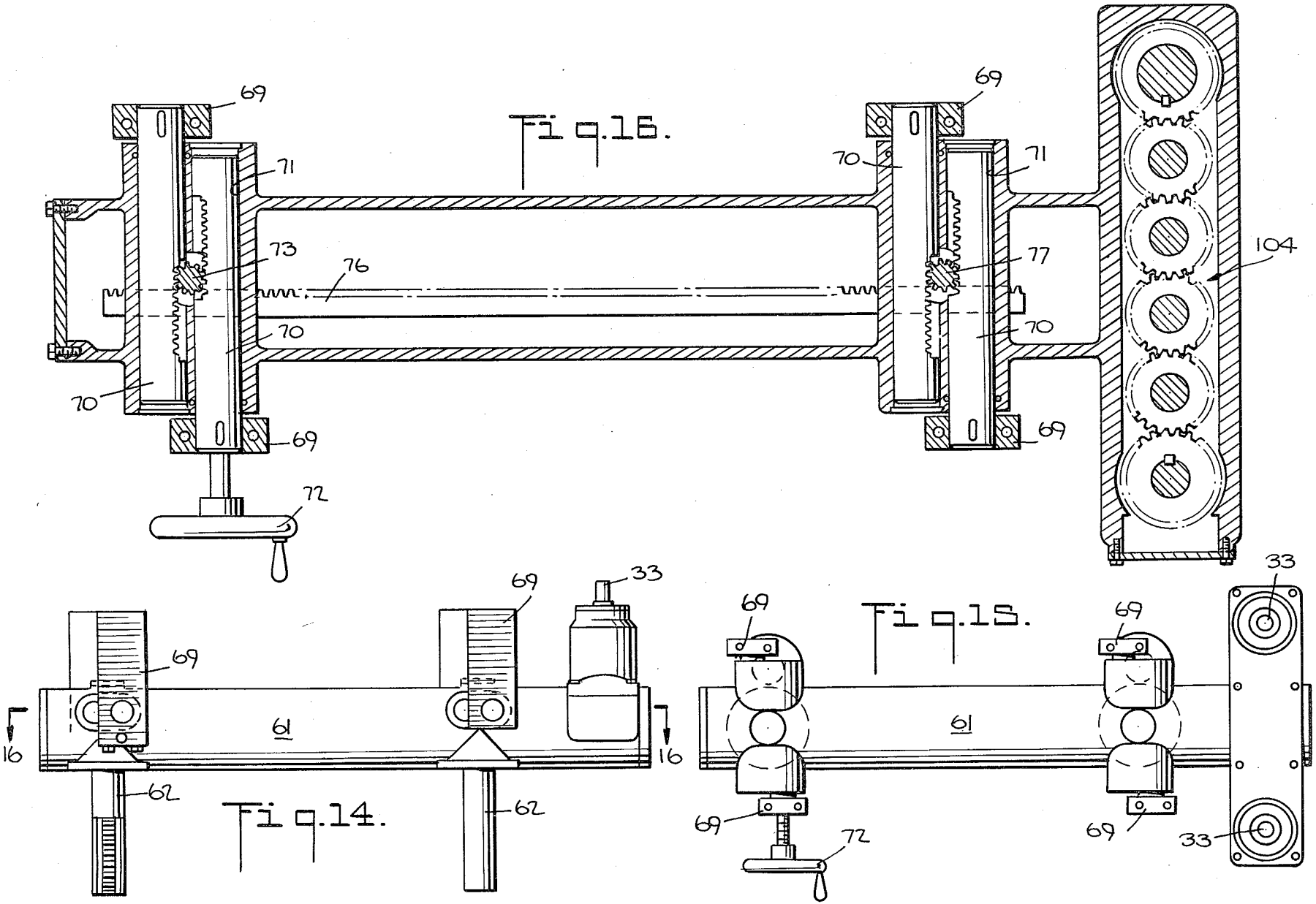
FIG. 14 is a detailed front elevational view of the side belt support assembly.
FIG. 15 is a top plan view of the support assembly of FIG. 14.
FIG. 16 is a horizontal sectional view taken along the line 16—16 on FIG. 14.
Figure 19:
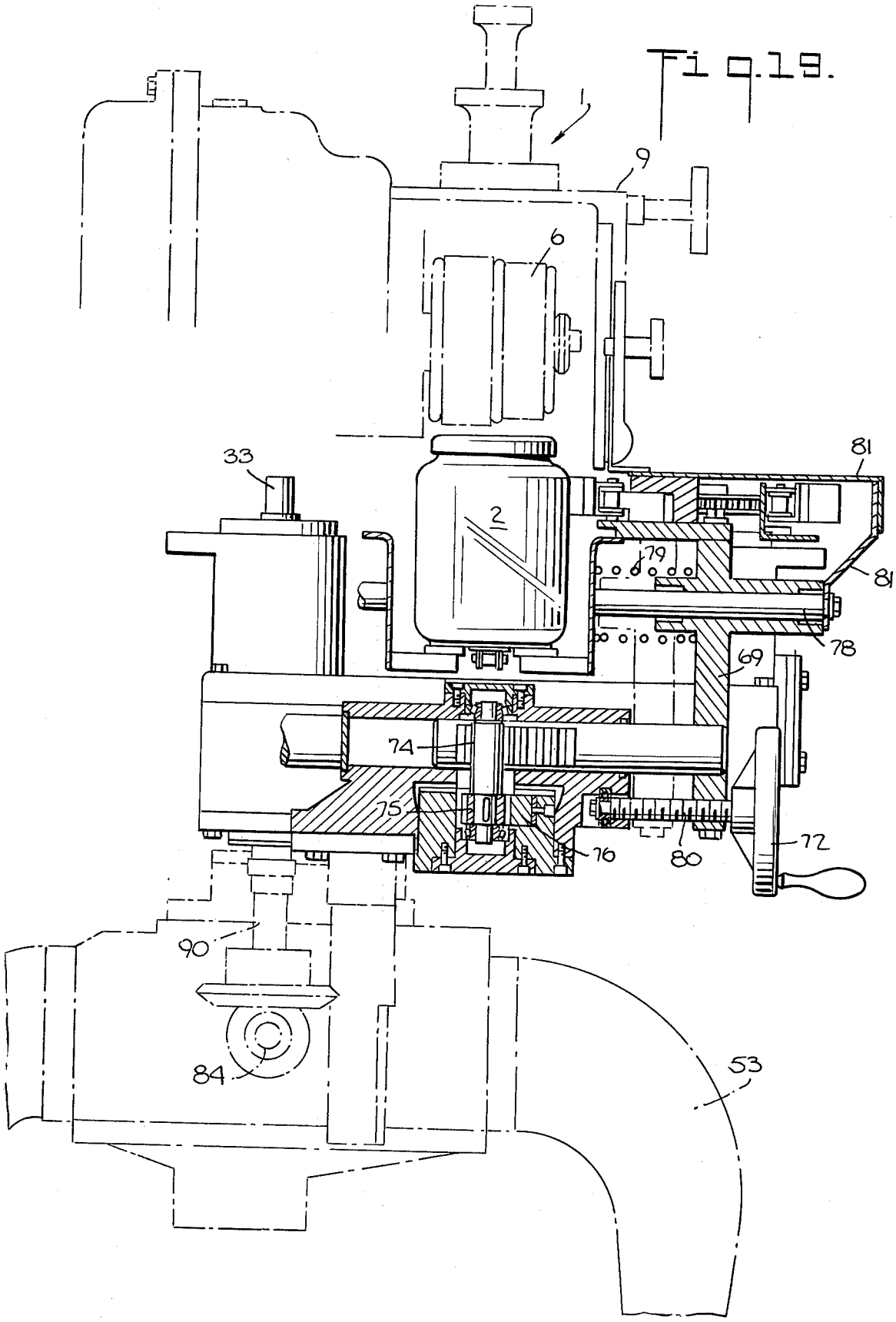

The coupling between the side belt support assembly 61 and the side belts 12 includes mens for adjusting the spacing of the side belts 12 for handling containers of differing diameters. Each of the two side belt mounting plates 46 are mounted on two longitudinally spaced support arms 69. Since the arms 69 are fixed vertically with respect to the above described side belt support assembly 61, the heights of the side belts 12 are adjustable as the side belt support assembly 61 is raised and lowered using the adjusting wheel 63 as described below. The arms 69, however, are adjustably mounted for lateral movement towards and away from each other to provide a side belt spacing adjustment. This adjusting means is illustrated in FIGS. 14 through 19. Each of the four arms 69 are attached to the outer end of a slidably mounted horizontal support rack 70 (FIG. 16). The racks 70 are mounted in suitable bearings 71 for horizontal movement under the control of a side belt width adjusting wheel 72. As best seen in FIG. 19, the wheel 72 is mounted on a shaft threadedly connected to the side belt support assembly 61. Turning the wheel 72 in one direction or the other causes a threadedly connected arm 69 to which one rack 70 is connected to move one way or the other laterally of the sealing machine. The movement of the one rack 70 results in a corresponding movement of the other three racks 70 and their attached mounting arms 69 through the intermediation of a pinion 73, an idler shaft 74 (FIG. 19), pinion 75 and rack 76. A corresponding idler shaft and pinions 77 couple the other two racks 70 to the rack 76. The support arms 69 support suitable bearing rods 78 and are spring loaded by coil springs 79 to provide a smooth spacing adjustment.

Suitable steam containing covers 81 are mounted on the side bearing rods 78 and other portions for adjusment therewith so that the covers 81 fit closely for differing size containers.

The above described adjusting means is seen to provide for the necessary sealing chamber and side belt height and spacing adjustments. The machine base 13 also incorporates an important portion of the machine drive system to permit these adjustments to be made independently of the drive and without the sealing machine. The machine drive system will now be described with particular reference to FIGS. 11 through 17 and 20 and 21.

A main drive shaft 82 is mounted in the machine base having a coupling portion 83 extending from the left side of the base 13 as seen in FIGS. 11, 12 and 13 for interconnection to the sealing machine main drive including a suitable electric motor and speed control and reduction devices, not illustrated.

As illustrated in FIG. 13, the main drive shaft 82 extends longitudinally through the hollow oil filled machine base chamber 52. The forward end of the drive shaft 82 is coupled by gears 83' to a drive shaft 84 which extends through the forward end of the base chamber 52 to provide a coupling 85 for the conveyor drive 86 (FIG. 1). The conveyor 3 is driven through the intermediation of horizontal conveyor drive shaft 87 and a right angle drive 88 to turn a conveyor drive sprocket. This positive coupling moves the conveyor 3 at a predetermined speed with respect to the speed of the main drive shaft 82 and the additional drive means coupled thereto. These additional drive means include a first splined vertical drive shaft 89 for coupling drive power to the sealing chamber and its driven elements and a second splined vertical drive shaft 90 for the side belts.

Figure 21:
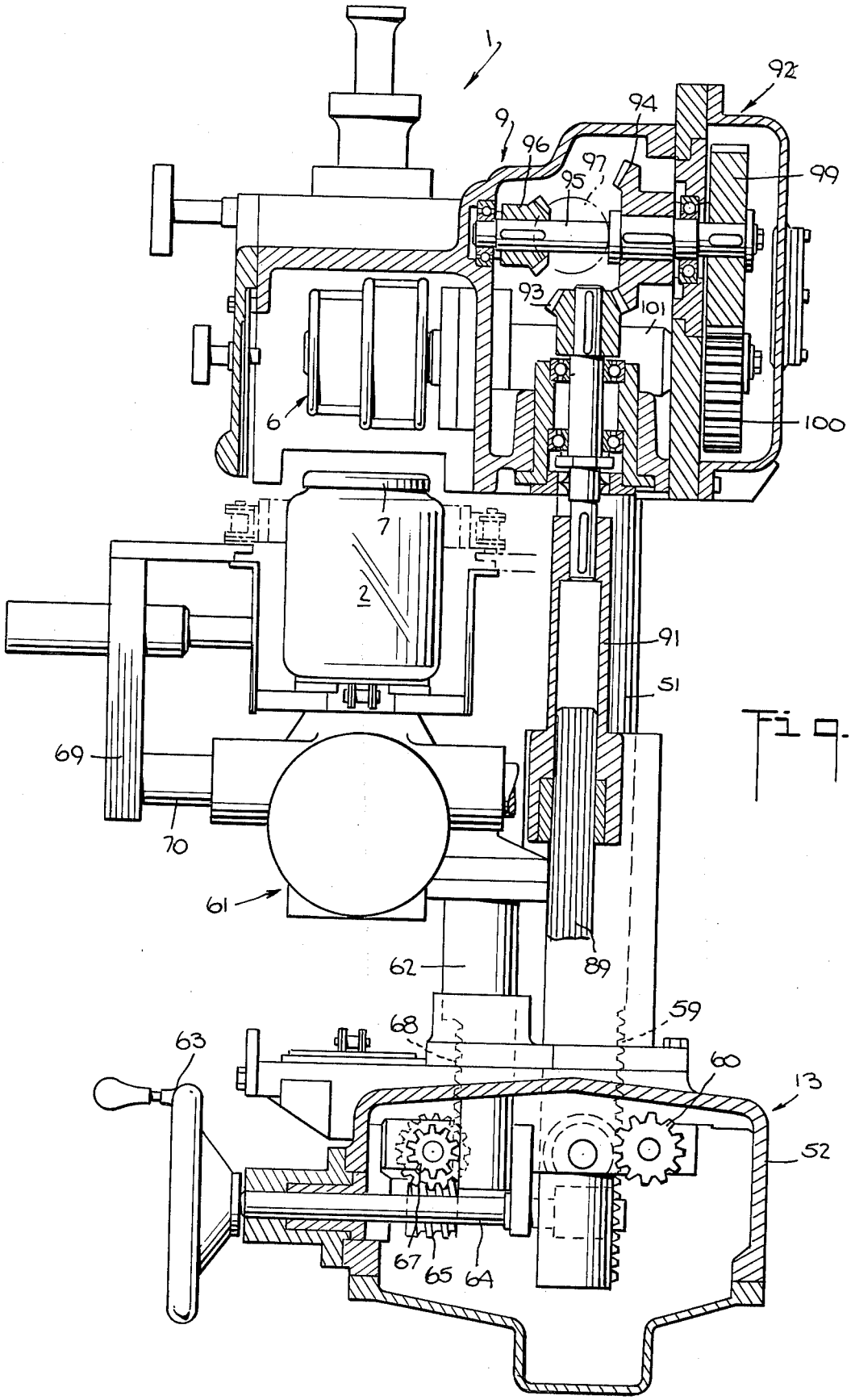

FIGS. 4 and 21 illustrate the drive transmission means whereby the driven elements in the sealing chamber 9 are coupled to the splined vertical drive shaft 89. As seen in FIG. 21, a hollow splined shaft 91 is positioned in telescoping and driven relationship with the splined shaft 89 to transmit the drive power upwardly to the sealing chamber 9 and to permit the chamber 9 to be moved vertically as the pair of splined shafts 89 and 91 slide longitudinally with respect to one another. A gear box 92 is provided on the forward portion of the sealing chamber 9 in which a bevel gear 93 on the upper end of the hollow splined shaft 91 engages a bevel gear 94 on a horizontal idler shaft 95. A bevel gear 96 on the idler shaft 95 drives a bevel gear 97 on the cap feed drive shaft 23 and a pinion 99 on an outer end of the idler shaft 95 engages gear 100 for driving the sealing head 6 pully drive support shaft 101. These positively geared couplings insure a synchronous coupling for their driven elements with respect to all other driven portions of the sealing machine which are a part of the main drive system. Where a coder 10 is used on the sealing machine, a coder drive shaft may also be coupled by means of a bevel gear 102 (FIG. 4) to the bevel gear.

Figure 20:
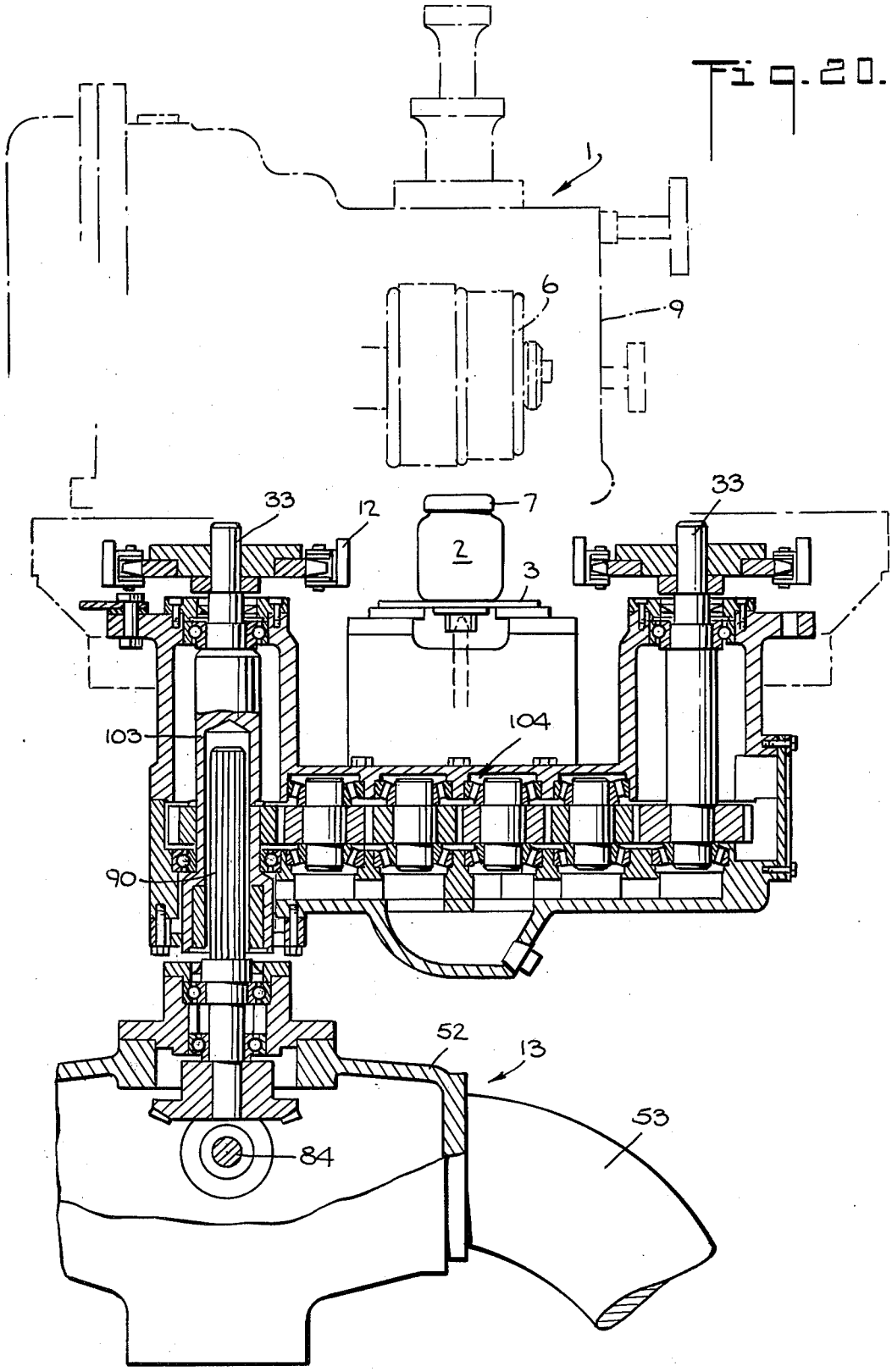

The forward vertical splined drive shaft 90 is used for driving the two side belts 12. This drive coupling also permits a height adjustment of the side belts 12 independently of the drive by including a hollow splined drive shaft 103 slidably engaging the lower splined drive shaft 90 (FIG. 20). The upper portion of the shaft 103 comprises the sprocket drive shaft 33 for driving one side belt 12. The opposite end side belt 12 is driven through the intermediation of a gear train 104 which couples the driven shaft 90 to the opposite support shaft 33 positioned at the exit end of the other side belt 12.

ALTERNATE BASE WITH POWERED ADJUSTMENTS

FIGS. 22 and 23 illustrate an alternate embodiment of the machine base 105 illustrating powered adjustments in place of the above described hand powered adjustments. An adjustment of the sealing chamber height and the side belt height has already been described utilizing hand wheels 55 and 63. The alternate embodiment provides for the substitution of power driven means for these adjustments. In this embodiment, an individual power source is mounted adjacent to the control shafts for the two height adjustments. Such power sources are illustrated at 106 and 107. These may comprise either electric or hydraulic drive motors under the control of suitable switches or other controls mounted in a convenient position on or near the sealing machine. The output of each of the power sources 106 and 107 are coupled to shafts 108 and 109 similar to the shafts 56 and 64 already described by suitable gear trains or other couplings. In the case of both electrical and hydraulic drives, limit stops may be provided to limit the adjustment within a predetermined overall adjustment range. A generally similar power means may also be utilized with the side belt spacing adjustment. The use of powered adjustments adapts the overall sealing machine set up to computer control, as for example, using program cards or other known control means so that the necessary height and belt width adjustments may be automatically and rapidly obtained when the cap and or container sizes are being changed merely by the insertion by the proper machine adjustment card or other prerecorded instructions.

It will be seen that an improved high speed sealing machine has been described in which the improvements are particularly directed to improvements in the cap feed and container control at the higher operating speeds together with significantly improved machine adjustment and drive means. Rapid machine adjustments may be made without disturbing the machine drive synchronization for differing container heights and widths and shapes. A particular improvement in the container feed provides a positive cap drive including a cap star feed wheel, which times the closure cap feed and which also isolates the closure cap pickup area from the necessarily high cap chute feed pressure.

The improved container control provides improved side belts with positive side belt container gripping. The improved machine adjustment features are combined with a compact and fully lubricated machine drive system adapted for full positive drive throughout the machine and for an overall reduced drive rate whereby substantial portions of the drive system operate at approximately the speed or rate required at that operating position. This results in a significant reduction of machine noise and vibration and provides for a smooth overall operation facilitating the higher sealing rates which may be employed.

Other and further advantages of the present invention will become apparent upon an understanding of the illustrative embodiments about to be described or will be indicated in the appended claims, and various advantages not referred to herein will occur to one skilled in the art upon employment of the invention in practice.

We claim:

1. In a straight line sealing machine having a container conveyor of fixed height with a cap applicator and a sealing head mounted on a sealing chamber positioned above said conveyor and container gripping side belts positioned on opposite sides of said conveyor, an improved mounting means for said sealing chamber and said side belts comprising the combination of:

a machine base;

a side belt support assembly;

a first column support means movably mounted on said base and mounting said sealing chamber at its top;

first adjusting means for adjusting the height of the first column support means for changing the height of said sealing chamber relative to said base;

a second column support means movably mounted on said base and mounting said side belt support assembly;

second adjusting means for adjusting the height of the second column support means for changing the height of said side belt support assembly relative to said base and independently of said first adjusting means;

third adjusting means on said side belt support assembly for adjusting the side belt spacing;

a drive shaft in said base;

first coupling means connecting said drive shaft to said sealing chamber independently of the sealing chamber height; and second coupling means connecting said drive shaft to said side belt support assembly independently of the side belt assembly height.

2. The machine as claimed in claim 1 in which said coupling means each comprise splined shafts.

3. The machine as claimed in claim 1 in which said first column support means comprise a plurality of columns.

4. The machine as claimed in claim 1 in which said second column support means comprises a plurality of columns.

5. The sealing machine as claimed in claim 1 in which said adjusting means is electrically operated.

6. The sealing machine as claimed in claim 1 in which said adjusting means is hydraulically operated.

7. The sealing machine as claimed in claim 1 in which said adjusting means is contained in an oil bath.

8. The sealing machine as claimed in claim 1 in which said side belt means includes means for sealing the container sealing zone and mounted for adjustment with said side belts.

* * * * *